United States Patent [19]

Imhoff

[11] Patent Number: 4,648,253

[45] Date of Patent: Mar. 10, 1987

[54] CELL LOCK

[75] Inventor: Lee A. Imhoff, Lakeview, Mich.

[73] Assignee: American Institutional Maintenance Corporation, Lakeview, Mich.

[21] Appl. No.: 733,105

[22] Filed: May 13, 1985

[51] Int. Cl.[4] ..... E05B 65/06; E05B 15/02

[52] U.S. Cl. ..... 70/135; 70/136; 70/150; 292/341.15; 292/210

[58] Field of Search ..... 49/16, 394, 503; 70/135, 136, 150; 292/207, 341.16, 341.15, 45, 48, 106, 216, 341.17, 144, 201, 210

[56] References Cited

U.S. PATENT DOCUMENTS

| | | | |
|---|---|---|---|
| 257,725 | 5/1882 | Lalor | 292/216 |
| 392,451 | 11/1888 | Ostrander | 292/201 |
| 420,834 | 2/1890 | Seib | 292/341.16 |
| 1,471,455 | 10/1923 | Ernst | 292/341.16 |
| 2,910,859 | 11/1959 | Allen et al. | 70/135 |
| 3,325,203 | 6/1967 | Moler | 292/207 |
| 3,451,704 | 6/1969 | Cothron | 70/135 |
| 3,521,921 | 7/1970 | Miyazaki | 292/341.16 |
| 3,543,547 | 12/1970 | Sugiyama | 292/341.16 |
| 3,667,793 | 6/1972 | Varrin et al. | 292/207 |
| 3,861,726 | 1/1975 | McLennan | 292/207 |
| 3,890,813 | 6/1975 | Cothron | 292/210 |
| 4,056,276 | 11/1977 | Jarvis | 292/201 |
| 4,180,287 | 12/1979 | Youngblood et al. | 292/144 |
| 4,262,830 | 4/1981 | Haves | 292/201 |
| 4,406,487 | 9/1983 | Stendal | 292/201 |
| 4,519,640 | 5/1985 | Mombelli | 292/144 |

*Primary Examiner*—Robert L. Wolfe
*Assistant Examiner*—Suzanne L. Dino
*Attorney, Agent, or Firm*—Price, Heneveld, Cooper, DeWitt & Litton

[57] ABSTRACT

A cell door lock for a cell door which pivots on a vertical axis includes a lock casing for mounting adjacent a door jamb associated with the door. A locking barrel is rotatably mounted to the casing for rotation on an axis parallel to the axis of rotation of the door and includes a locking element extending from the casing toward the door for selectively engaging the surface of the door opposite the door jamb for holding the door in a closed position. A movable locking bar co-operates with the barrel for selectively preventing rotation of the barrel to selectively lock the door in its closed position.

12 Claims, 7 Drawing Figures

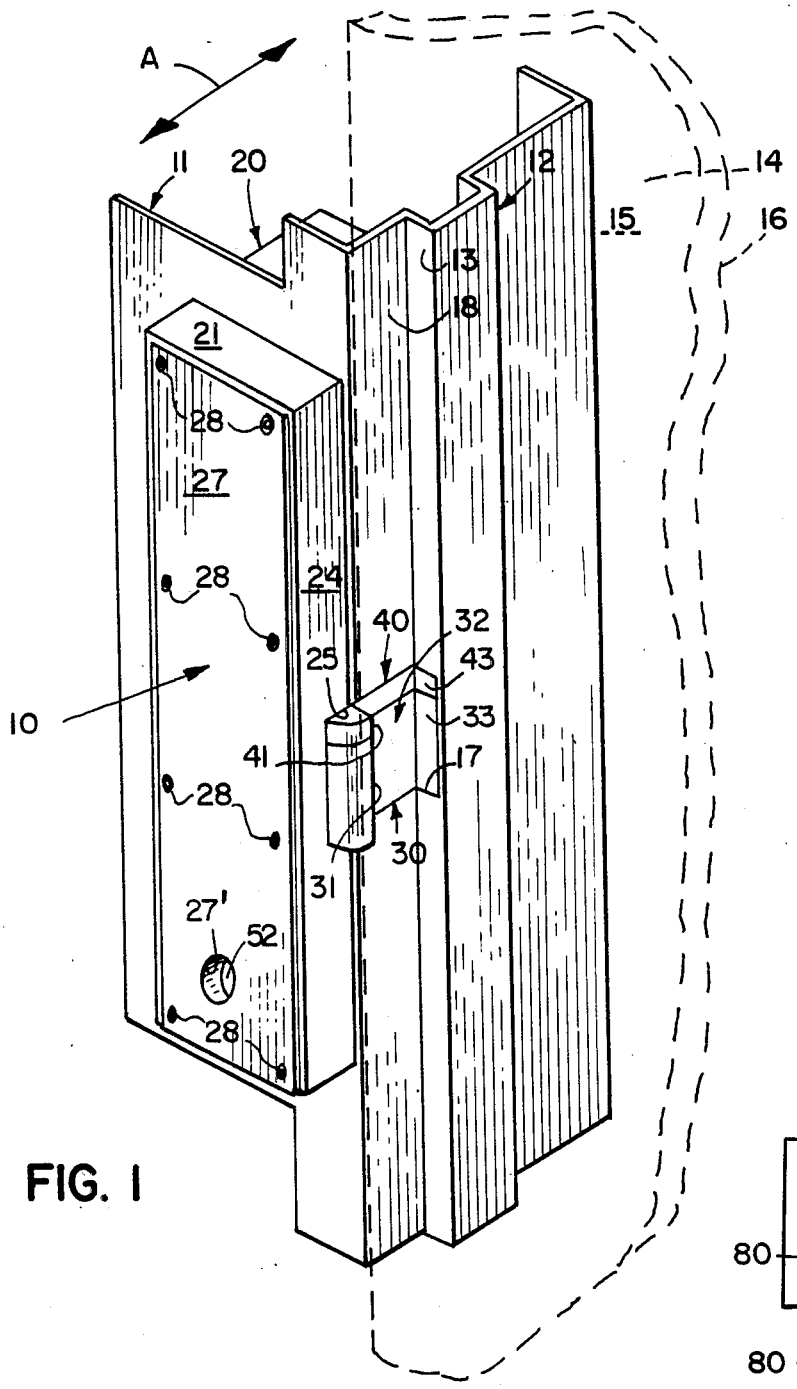
FIG. 1
FIG. 6
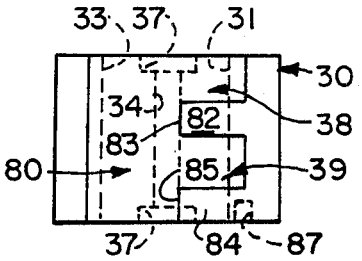
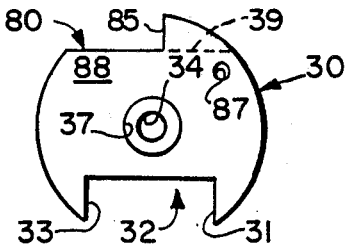
FIG. 7

CELL LOCK

BACKGROUND OF INVENTION

The present invention pertains to locks and, particularly, a lock adapted for use in a prison cell.

In prison cells incorporating vertically swinging-type doors, typical lock systems incorporate a sliding deadbolt lock mounted within the door, the key operated lock has a bolt which travels into the opening formed in the door jamb for captively holding the deadbolt preventing the door to be opened. U.S. Pat. No. 2,417,167 discloses a prison lock system incorporating this type of conventional lock. When such locks are opened, it is possible for a prisoner to insert foreign material into the bolt receiving slot thereby preventing the relocking of the door without first clearing the foreign material. Also, such locks must be carefully designed to prevent tampering with the locking mechanism itself. The conventional sliding deadbolt locks of this type are not self-locking and always require a control operation by a guard in ofder to secure the cell door.

SUMMARY OF THE PRESENT INVENTION

The cell lock of the present invention provides an automatic locking mechanism which employs a unique rotary locking cylinder or barrel having a deadbolt locking bar holding the barrel in a locked position. A lift cam is coaxially mounted with the locking barrel and, like the locking barrel, is spring loaded and cooperates with the locking bar to normally hold the locking barrel in an open door-receiving position whenever the cell door is opened. Upon closure of the cell door, the barrel is moved by the door to a deadbolt locked position. The lock is designed for a vertically swinging door which itself contains no part of the locking mechanism, thereby simplifying the door design by placing the entire locking mechanism sealed within the door frame and jamb structure. The locking mechanism can be actuated mechanically or electrically in a variety. of modes.

Locks embodying the present invention include a generally cylindrical locking barrel having a longitudinally extending door receiving slot and surface means for engaging a locking bar for selectively preventing rotation of said barrel. The barrel is rotatably mounted within a lock case secured in the door frame such that the slot can selectively engage an edge of the swinging door mounted within a door frame to hold the door in a closed and locked position. Bias means are coupled between the locking barrel and the mounting structure for urging the barrel into a first door receiving and unlocked position, but allowing the barrel to rotate to the second locked position. A locking bar is mounted within the case and is movable between a first position allowing rotation of the barrel to the unlocked position and a second position engaging the surface of the barrel to prevent its rotation from its locked position.

In a preferred embodiment of the invention, the locking bar is moved by a rotating lifter cam coaxially mounted with respect to the locking barrel including a camming surface engaging a follower associated with the locking bar, the cam is biased for lifting the locking bar whenever the door is unlocked to allow the barrel to rotate to the first door receiving position. Means are provided for selectively moving the locking bar between the second locked position and the first unlocked position.

In the preferred embodiment, the locking bar can be moved to the first unlocked position by an electrically operated solenoid or alternatively by mechanical means such as a key operated bolt lock or a mechanical lever controlled remotely from the cell.

The cell lock of the present invention, therefore, provides a unique rotatable locking mechanism which is biased in a normally open door receiving position when the cell door is open and automatically locks by rotating and circumscribing and holding the door in a closed position when the door is closed. These and other features, objects and advantages of the present invention will become apparent upon reading the following description thereof together with reference to the accompanying drawings in which:

BRIEF DESCRIPTION OF THE DRAWINGS

FIG. 1 is a fragmentary perspective view of a cell door installation including a lock embodying the present invention;

FIG. 6 is a left side elevational view of the locking barrel shown in FIG. 2; and FIG. 7 is a bottom plan view of the barrel shown in FIG. 6.

DETAILED DESCRIPTION OF THE PREFERRED EMBODIMENT

Figure 2:
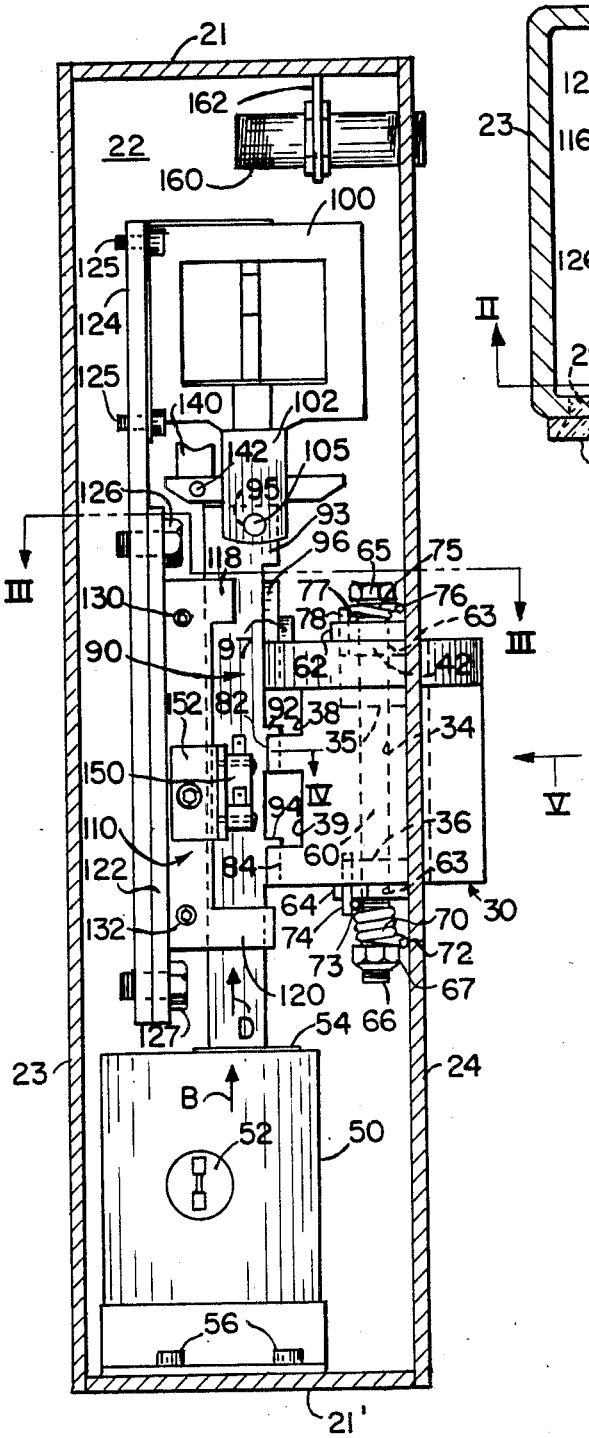
FIG. 2 is a vertical cross-sectional view of the lock assembly taken along the sectional line II—II shown in FIG. 3.

Referring initially to FIG. 1, there is shown a cell lock assembly 10 of the present invention shown mounted in the door frame 11 which also supports a vertically swinging-type cell door 14. Door 14 can be a steel clad door or a conventional bar type cell door which swings along a vertical pivot axis indicated generally by arrow A between an open position and a closed position as shown in phantom lines in FIG. 1. When closed it seats against the forward facing surface 13 of jamb 12 associated with door frame 11. The door frame 11 and the jamb associated therewith is made of suitable plate steel with the lock assembly 10 being welded thereto during installation.

The lock assembly 10 is a self-contained unit which is mounted within a sealed case 20 and includes a rotatable locking barrel 30, which is described in detail below. Briefly, barrel 30 includes a slot 32 and formed therein for gripping the edge of door 14, holding it in a locked position. The lock assembly further includes a lift cam 40 which rotates on an axis common with the locking barrel 30 and, as described below, maintains the lock in an unlocked position when the door is opened. With the locking system of the present invention, therefore, door 14 needs no interface structure, although the area near the lock typically will be reinforced or of solid metal as illustrated in FIG. 3. The door engaging slot 32, of locking cylinder 30, similarly engages the rear surface 16 of door 14 and, when the barrel 30 is rotated to an open door receiving position as shown in phantom lines in FIG. 3, the door engages the edge of surface 33 causing the rotatable cylinder 30, as well as lifting cam 40, to rotate to the closed locked position illustrated in FIGS. 1 and 3. Having briefly described the mounting relationship of the lock assembly 10 to the door frame and door, a detailed description of the locking mechanism itself is presented in conjunction with the remaining FIGS. 2–7.

Figure 3:
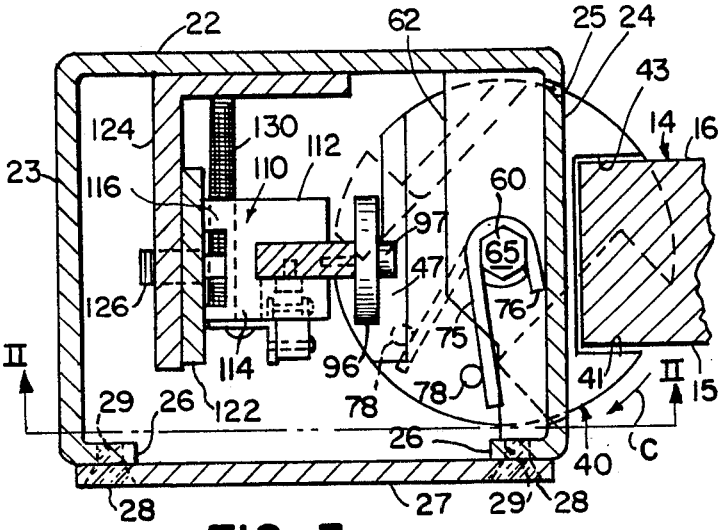
FIG. 3 is an enlarged fragmentary cross-sectional view of the structure shown in FIG. 2 taken along section lines III—III of FIG. 2.

As shown in FIGS. 2 and 3, the lock case 20 includes an integral formed metal case having a rear wall 22, left side wall 23 and right side wall 24 with a rectangular aperture 25 (FIGS. 1 and 5) formed therein for allowing cylinder 30 and life cam 40 to project outwardly therefrom. In the embodiment shown, door frame 11 includes a rectangular aperture 17 (FIG. 1) formed through wall section 18 and jamb surface 13 and aligned with aperture 25 formed in side wall 24 of lock case 20 for permitting barrel cylinder 30 and cam 40 to extend into the door jamb, as illustrated in FIG. 1.

The forward edges of walls 23 and 24 are inwardly formed as seen in FIG. 3 to define flanges 26 to which a front cover plate 27 is secured by means of a plurality of twist-off bolts 28 which are fitted within threaded apertures 29, formed at spaced intervals along the flanges 26. Bolts 28 are conventional and of the type which, when tightened beyond a predetermined torque, a portion of the heads shear off leaving no means for removal other than by drilling. Case 20 further includes a top plate 21 and a bottom plate 21 welded to the sides and back to complete the elongated rectangular case. Centered at the lower end of cover plate 27 is an aperture 27, providing access to a mechanical key operated lock mechanism 50 (FIG. 2) and a key-operated tumbler 52 aligned with opening 27'. Lock 50 includes a bolt 54 which moves vertically in a direction indicated by arrow B in FIG. 2 for providing a mechanical unlocking operation of lock mechanism 10, as described in greater detail below. Lock 50 is secured to the floor 21' of a case 20 by a plurality of mounting bolts 56.

The locking cylinder 30 and lift cam 40 are independently rotatably mounted to the inner surface of side wall 24 in alignment with aperture 25 by means of a pivot axle 60 which, in the preferred embodiment, is a vertically extending bolt 60 (FIGS. 2 and 3). Bolt 60 is supported between a pair of spaced mounting plates 62 and 64, which, as best seen in FIG. 3, extend and are welded between walls 22 and flanges 26 of the lock casing and are also welded to the side wall 24. Each of the plates 62 and 64 include an aperture 63 permitting the bolt to extend therethrough. In the preferred embodiment, bolt 60 has a hexhead 65 and a threaded end 66 for receiving a self-locking nut 67.

Figure 5:
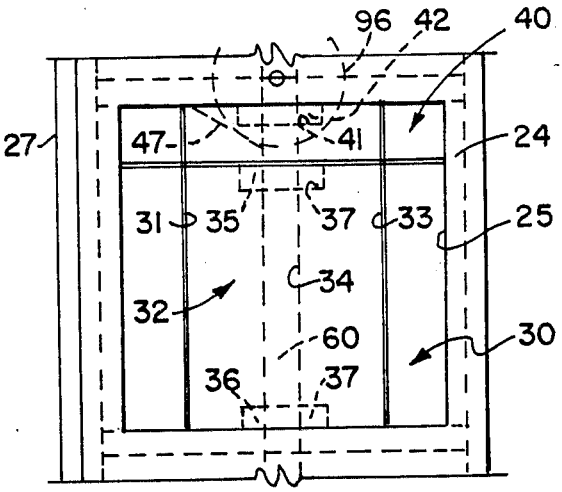
FIG. 5 is a fragmentary enlarged right side elevational view taken in the area and direction of arrow V in FIG. 2.

Locking cylinder 30 is rotatably positioned over bolt 60 by means of a longitudinally extended central bore 34 extending along its longitudinal axis and a pair of press-fit bearings 35 and 36 at the upper and lower ends of the cylinder as seen in FIGS. 2 and 5. Bearings 35 and 36 are mounted within the cylindrical recesses 37 and are press-fit therein to provide smooth rotation of the cylinder 30 with respect to the pivot axle 60. The disk-shaped lift cam 40 similarly is rotatably mounted to pivot axle 60 by means of a bearing 42 press-fit within a circular aperture 41 formed downwardly in the top surface of cam 40. Thus, barrel cylinder 30 and lift cam 40 are independently rotatably mounted about the vertical axis defined by bolt 60 between mounting plates 62 and 64 to provide relatively free rotation, restrained only by the independent bias means for each of the members.

The locking cylinder 30 is biased in a first or normally opened position for receiving the door, as illustrated in phantom lines in FIG. 3 by means of a heavy-duty coil compression spring 70 (FIG. 2) having one end 72 engaging the inner surface of wall 24 and an opposite end 73 engaging a dowel pin 74 press fit in an aperture 87 (FIGS. 6 and 7) formed in barrel 30. Spring 70 is coaxially mounted at the lower end of bolt 60 and is held in axial position between the lower surface of mounting plate 64 and the upper surface of lock nut 67. Thus, spring 70 provides a rotational force for barrel 30 which acts in a direction indicated by arrow C in FIG. 3 for urging the barrel toward an open position (i.e. clockwise when viewed from the top).

Similarly, lift cam 40 is biased in the same direction by a coiled compression spring 75, likewise, surrounding and mounted coaxially on bolt 60 with one end 76 engaging the inner surface of wall 24 of the lock casing and an opposite end 77 engaging a dowel pin 78 in cam 40, as shown in FIG. 3, such that cam 40 is also biased in a forward facing direction, as shown in FIG. 3. The spacing between the lower surface of mounting plate 62 and the upper surface of plate 64 is such to allow relatively free rotation of the barrel 30 and cam 40 through an arc of approximately 40 degrees for urging these members between their first and second positions, corresponding to the door open position and door locked position, respectively. The barrel is restrained in its movement in the direction indicated by arrow C by the edges of slots 38 and 39 in barrel 30 contacting locking tabs 92 and 94 when raised to an unlocked position while cam 40 includes a stop pin (not shown) for also engaging locking bar 90 described below.

The cylindrical locking barrel 30 is shown in greater detail in FIGS. 6 and 7 and is machined from a solid block of ASTM 1144 steel and includes the longitudinally extending slot 32 shaped to conform to the edge of door 14, as best seen in FIG. 3. On a side opposite slot 32 of the longitudinally extending axial bore 34, there is provided a pair of slots 38 and 39 which are vertically spaced and extend transverse to the longitudinal axis of the cylinder as best seen in FIG. 6. A vertical cut 80 is formed in a longitudinal direction to relieve the cylinder thus defining a longitudinally extending slot 80 which, together with transverse slots 38 and 39, define two spaced locking tabs 82 and 84 having rearwardly projecting surfaces 83 and 85, respectively, for engaging tabs 92 and 94 on the locking bar 90 as described below. Surfaces 83 and 85 are vertically spaced and in alternate staggered relationship with respect to slots 38 and 39. An aperture 87 is drilled upwardly through the bottom surface 88 of the barrel to receive pin 74, as illustrated in FIG. 2, which serves as the spring contact member between the bias spring 70 and the barrel cylinder 30. The mechanism for selectively preventing rotation of the door engaging barrel 30 and thus locking door 14 is now described with particular reference to FIGS. 2 and 3.

Figure 4:
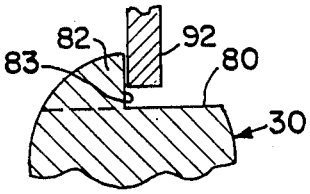
FIG. 4 is a fragmentary cross-sectional view of a portion of the lock taken along section line IV of FIG. 2.

A locking bar 90 serves to selectively prevent rotation of barrel 30 and moves vertically between a lowered locking position in which locking tab 92 engages surface 83 of tab 82 on barrel 30, as illustrated in Fig. 4, and locking tab 94 extending outwardly from the rectangular locking bar 90 engages surface 85 of tab 84 on the locking barrel. The locking bar is raised in a direction indicated by arrow D (FIG. 2) either by the mechanical lock 50 or by solenoid 100 until tabs 92 and 94 raise into the clearance defined by notches 38 and 39 to allow the spring 70 to urge the barrel in the direction shown by arrow C in FIG. 3 for unlocking the cell door 14.

The vertically slidable locking bar 90 includes a roller cam follower 96 which is rotatably mounted to the right edge of bar 90 by means of a machined threaded fastener 97 permitting rotation of the follower 96. Follower 96 engages an inclined ramp surface 47 (FIGS. 3 and 5) machined in the upper surface of cam lifter 40, such that when the door is unlocked, and the disk-shaped lifter 40 is free to rotate, spring 75 will cause its rotation in the direction indicated by arrow C causing the follower to ride up inclined ramp 47 raising the locking bar 90, thereby preventing a prisoner from moving and locking the cylinder 30 in the locked position shown in FIG. 1 when the cell door is opened. If an attempt is made to rotate the locking cylinder and lift cam, the lift cam will simply rotate when released to again raise the locking bar preventing the locking barrel from remaining in a locked position while the door is opened. With the door closed, cam 40 is restricted from movement by the door and the gravity-dropped locking bar 90 remains in the locked position shown in FIG. 2, unless mechanically moved either by the solenoid 100, mechanical lock 50 or by an auxiliary lift bar 140 (FIG. 2).

The locking bar 90 is slidibly and guidably supported by a generally U-shaped support member 110, having a rear leg 112, a forward leg 114 and a base 116 therebetween. Legs 114 and 116 are cut away to define upper and lower extensions 118 and 120, respectively, which extend on opposite sides of the bar. U-shaped guide 110 is in turn welded to a support plate 122 which in turn is adjustably mounted to an angle bracket 124 welded to the rear wall 22 of lock case 20, as best seen in FIG. 3. For purposes of adjustably mounting plate 122 and guide 110 welded thereto to bracket 124, elongated slots are formed through plate 122 and threaded fasteners 126 and 127 extend through plate 122 into threaded apertures in bracket 124. A pair of adjustment screws 130 and 132 are threaded through guide 110 and extend into engagement with bracket 124, as best seen in FIG. 3, to provide the adjustment of the guide bracket with respect to the rear wall thereby adjusting the angular rotational locked position of the barrel 30 as necessary to provide square alignment with respect to the door in the position illustrated in FIG. 3. Once the screws 130 and 132 have been adjusted to provide the desired square relationship of the notch 32 in locking barrel 30, the threaded fasteners 126 and 127 are secured holding the guide 110 in position. Fasteners 130 and 132 are preferably socket-head screws which can be adjusted by an allen wrench.

The upper end 93 of locking bar 90 includes an aperture 95 which is secured to the armature 102 of electrically operated solenoid 100 in turn bolted to bracket 124 by a pair of spaced fasteners 25. A suitable fastener 105 extends through aperture 95 and armature 102 to provide a interconnection between locking bar 90 and the armature. Solenoid 100 is electrically coupled through conventional wiring to a power source through a momentary push-button switch located at a remote control area accessible only by a guard.

When the solenoid is activated armature 102 lifts the locking bar momentarily until locking tabs 92 and 94 clear tabs 82 and 84 on barrel 30 allowing spring 70 to rotate the cylinder in the direction indicated by arrow C. Spring loaded barrel 30 thus forces door 14 to an open, ajar position. With the door open, the locking barrel and lift cam 30 and 40, respectively remain in an open position as shown in phantom lines of FIG. 3 with surfaces 43 and 33 projecting forwardly of surface 13 of the door jamb 12 in a position to contact the rear surface 16 of the door when it is again closed.

Armature 102 is also coupled to a manual lift level 140 through a pivot coupling 142. Arm 140 extends upwardly through a suitable slot formed in upper wall 21 of the lock case 20 to a conventional overhead control arm lifting mechanism which provides a remote mechanical unlocking capability for the locking bar 90 at the guard control location. Thus, locking bar 90 can be unlocked to open door 14 by two mechanical means comprising mechanical lock 50 through the raising of bolt 54 and thereby pushing on the lower end of locking bar 90, or by a manually actuated lifting arm 140. Alternatively and typically, the door is unlocked by momentary actuation of a push-button switch which momentarily energizes the solenoid 100.

Two sensors provide signal information to an electrical control circuit (not shown) for indicating the closed locking of the door. First a limit switch 150 is mounted to guide 110 by bracket 152 (FIG. 2). Switch 150 includes a sensing element which engages a projection formed on locking bar 90 such that switch 150 is actuated only when the locking bar is in the lowered locked position as illustrated in FIG. 2. Additionally, a metallic proximity switch 160 (FIG. 2) is mounted to the lock case 20 through bracket 162 and detects the presence of door 14 in proximity therewith. The sensors 150 and 160 are electrically coupled to a logic circuit which 'ands' the signals therefrom to provide a green or locked door signal to the guard control station only when the locking bar 90 is lowered indicating the door is locked and the door is present in the door jamb as detected by sensor 160. The sensors, therefore, provide electrical signals which can be employed for providing a visual indication that the door is secured. Whenever lock 10 is unlocked, the door will be automatically kicked to an ajar position by the force of spring 70 which provides approximately a 20 to 30 foot pound torque for opening the cell door.

Thus, with the lock system of the present invention, a rotatable barrel lock is provided which, when the prison door is open, cannot be tampered with by locking, due to the utilization of the automatically operated cam lifter associated with the lock. The lock can be operated in a variety of mechanical and electrical modes for unlocking when desired and includes sensors which provide signals for providing a visual indication of the locked status of a cell. The cylindrical barrel, locking bar, and cam lifter are all made of 1144 steel. The overall height of barrel 30 in the preferred embodiment was approximately 2 $\frac{5}{8}$ inches and had a diameter of approximately 3 $\frac{1}{2}$ inches. The slot 32 for receiving the door was approximately 2 inches in width to conform to the dimensions of a 2 inch door and had a depth of $\frac{3}{4}$ inch. Bore 34 accommodates a $\frac{3}{8}$ inch diameter hardened steel pivot bolt 60 around which the locking barrel rotates. All of the bolts employed in connection with mounting the guide means are hardened steel. Solenoid 100 and sensor 160 are commerically available, the solenoid provides approximately a 23 pound pull force, which is more than adequate for lifting the locking bar. The locking bar moves freely along guide 110 and will lower to a locked position by gravity under its own weight when the door closes.

It will become apparent to those skilled in the art that various modifications to the preferred embodiment of the invention can be made without departing from the spirit or scope thereof as defined by the appended claims.

The embodiments of the invention in which an exclusive property or privilege is claimed are defined as follows:

1. A lock for a door which pivots on a vertical axis between open and closed positions, said lock comprising:

a lock casing for mounting adjacent a door jamb associated with the door;

a locking member comprising a cylindrical body including means defining at least one locking surface and means for rotatably mounting said locking member to said casing for rotation on an axis generally parallel to the axis of rotation of the door, said locking member including a locking element comprising a slot extending longitudinally through the wall of said body and extending from said casing toward the door for selectively engaging a surface of the door opposite the door jamb for holding the door in a closed position, said locking member rotatable to another position for releasing the door;

means for selectively preventing rotation of said locking member for locking the door in closed position wherein said means for selectively preventing rotation of said locking member comprises a locking bar mounted for movement between positions for selectively engaging said locking surface for preventing rotation of said body and means for moving said locking bar between a locked position, engaging said locking surface and an unlocked position spaced from said surface; and cam means rotatably mounted coaxially with and independently of said body, first bias means for urging said cam means toward a predetermined position, said cam means including an element engaging the door for preventing movement of said cam means when the door is closed and wherein said locking bar includes a cam follower engaging said cam means such that said locking bar is moved to said unlocked position by said cam means when said door is opened and said cam means rotates to said predetermined position.

2. The apparatus as defined in claim 1, and further including second bias means coupled to said cylindrical body to move said body to an unlocked position whenever said locking bar is in an unlocked position.

3. The apparatus as defined in claim 2, wherein said means for moving said locking bar further includes a solenoid coupled to said bar.

4. The apparatus as defined in claim 3, wherein said means for moving said locking bar further includes a key operated lock having a bolt engaging an end of said locking bar for moving said locking bar.

5. The apparatus as defined in claim 1, wherein said means for moving said locking bar includes an electrically actuated solenoid.

6. A lock for a door which pivots on a vertical axis between open and closed positions, said lock comprising:

a lock casing for mounting adjacent a door jamb associated with the door;

a locking member and means for rotatably mounting said locking member to said casing for rotation on an axis generally parallel to the axis of rotation of the door, said locking member including a locking element extending from said casing toward the door for selectively engaging a surface of the door opposite the door jamb for holding the door in a closed position, said locking member rotatable to another position for releasing the door;

means for selectively preventing rotation of said locking member for locking the door in closed position; and cam means rotatably mounted coaxialy with and independently of said locking member, first bias means for urging said cam means toward a predetermined position, said cam means including an element engaging the door for preventing movement of said cam means when the door is closed, said cam means engaging said means for selectively preventing rotation of said locking member such that said means is moved to an unlocking position by said cam means when said door is opened and said cam means rotates to said predetermined position.

7. The apparatus as defined in claim 6, and further including second bias means coupled to said locking member to move said member to an unlocked position whenever said preventing means is in an unlocked position.

8. A lock having a rotating locking member, said lock comprising:

a locking barrel including slot means for engaging the edge of a closure member to be locked, said barrel further including a plurality of longitudinally spaced locking projections;

means for mounting said barrel with respect to the closure member for rotating said barrel between positions for selectively locking and unlocking the closure member and further including bias means coupled to said barrel for urging said barrel toward an unlocked position;

a locking bar mounted for movement between positions for selectively engaging said locking projection for preventing rotation of said barrel, and wherein said locking bar includes a plurality of locking tabs spaced to selectively align with said projections, and wherein said locking bar is mounted to move in a direction generally parellel to the axis of rotation of said barrel;

means for moving said locking bar between a locked position engaging said locking projection and an unlocked position spaced from said projections wherein said means for moving said locking bar includes an electrically actuated solenoid; and cam means rotatably mounted coaxially with and independently of said barrel, second bias means for urging said cam means toward a predetermined position, said cam means including an element engaging the door for preventing movement of said cam means when the door is closed and wherein said locking bar includes a cam follower engaging said cam means such that said locking bar is moved to said unlocked position by said cam means when said door is opening and said cam means rotates to said predetermined position.

9. The apparatus as defined in claim 8 and further including a first sensor positioned to engage said locking bar to provide a signal indicating that said locking bar is in a position engaging said locking projection.

10. The apparatus as defined in claim 9, and further including second sensor menas positioned on said mounting means for detecting when the door is in a closed position in said locking barrel.

11. A cell lock for a cell having a vertically pivoted door comprising:

a generally cylindrical locking barrel including a longitudinally extending door receiving slot, said barrel further including surface means for engaging a locking bar for preventing rotation of said barrel;

means for rotatably mounting said barrel in a door jamb associated with a door frame such that said slot can selectively engage an edge of a swinging door mounted within the door frame to hold the door in a closed and locked position;

first bias means coupled between said barrel and said mounting means for urging said barrel into a first door receiving unlocked position and allowing said barrel to rotate to a second locked position;

a locking bar mounted within said mounting means and movable between a first position allowing rotation of said barrel to said first position and a second position engaging said surface of said barrel to prevent its rotating from said second position; and means for moving said locking bar between said second and first positions wherein said moving means includes cam means rotatably mounted coaxially with and independently of said barrel, second bias means for urging said cam means toward a predetermined position, said cam means including an element engaging the door for preventing movement of said cam means when the door is closed, and wherein said locking bar includes a cam follower engaging said cam means such that said locking bar is moved to said first position by said cam means when said door is opened and said cam means rotates to said predetermined position.

12. The apparatus as defined in claim 11, wherein said moving means further includes an electrically operated solenoid coupled to said locking bar for moving said bar to said first position.

* * * * *